US005771655A

United States Patent [19]

Strickland et al.

[11] Patent Number: 5,771,655

[45] Date of Patent: Jun. 30, 1998

[54] SYSTEM AND METHOD FOR CONSTRUCTING METAL FRAME STRUCTURES

[75] Inventors: Michael R. Strickland, Hanover; Kevin O. Clark, Salem, both of Mass.

[73] Assignee: Canam Steel Corporation, Point of Rocks, Md.

[21] Appl. No.: 573,928

[22] Filed: Dec. 18, 1995

[51] Int. Cl.[6] ..... E04G 21/10; E04G 21/18; E04B 1/35

[52] U.S. Cl. ..... 52/745.2; 52/650.3; 52/654.1; 52/655.1; 52/656.9

[58] Field of Search ..... 52/408, 409, 536, 52/650.3, 105, 654.1, 655.1, 656.9, 745.19, 745.2

[56] References Cited

U.S. PATENT DOCUMENTS

| | | | |
|---|---|---|---|
| 4,080,771 | 3/1978 | Weller | 52/105 X |
| 4,282,619 | 8/1981 | Rooney | 52/650.3 X |
| 4,337,287 | 6/1982 | Falkenberg | 52/654.1 X |
| 4,486,998 | 12/1984 | Hague | 52/536 X |
| 4,858,399 | 8/1989 | Salato, Jr. | 52/105 X |
| 4,863,189 | 9/1989 | Undsay | 52/650.3 X |
| 4,965,980 | 10/1990 | Leavens | 52/105 X |
| 5,251,415 | 10/1993 | Van Auken et al. | 52/408 X |

FOREIGN PATENT DOCUMENTS

| | | | |
|---|---|---|---|
| 765474 | 9/1980 | U.S.S.R. | 52/650.3 |

OTHER PUBLICATIONS

"Architecture Magazine", Jun. 1990, p. 20.

*Primary Examiner*—Carl D. Friedman
*Assistant Examiner*—Yvonne Horton-Richardson
*Attorney, Agent, or Firm*—Cesari and McKenna, LLP

[57] ABSTRACT

A system and method for constructing metal frame structures provides a framework in the form of a jig that is typically assembled at a construction site at ground level. The jig is filled with joists that are typically parallel to each other and spaced at predetermined intervals along the jig. A pair of indicator jig sections are used at either end of the grouping of joists. These indicators include a corrugated decking surface along their top. Decking sheets are laid over the joists so that they nest within the indicator decking. The decking is permanently joined to the joists, but not the indicator decking. The assembled decking and joists are lifted from the framework and positioned within a building framework. Further sections are constructed using the same technique until a or roof surface is formed over the entire framework. Utilities can be located within the assembled decking and joist framework while it is still on the ground.

9 Claims, 7 Drawing Sheets

SYSTEM AND METHOD FOR CONSTRUCTING METAL FRAME STRUCTURES

FIELD OF INVENTION

This invention relates to a system and method for constructing metal frame structures, and more particularly, to a modular floor joist and bridging system that can be assembled on the ground using a jig.

BACKGROUND OF INVENTION

Over the years, the construction of metal frame buildings has remained largely the same. A conventional approach to constructing a building is detailed in FIG. 1. A group of vertical metal columns 20 are erected. These columns 20 are tied together by a series of girder beams 22 that can be formed as truss members (as shown) or as solid I-beams. The girder beams 22 and columns 20 are typically joined by welding, riveting, bolting or a combination of joining techniques. In most buildings, a plurality of bays 24 are defined by crossing girder beams and columns 20. Once the framework of girder beams 22 and columns 20 is erected, a series of floor joists 26 are laid in parallel into each bay. The floor joists 26 are also formed, in most instances, as truss-works with overlapping end sections 28 that lay upon the girder beams 22. As used herein, floor joists and roof joists are interchangeable terms since such joists can be used either to hold up a floor for the next story or a roof.

The joists are typically inserted one-at-a-time using a crane, and are guided into a final aligned position by workers who are suspended on the framework during construction.

The joints 26 are each secured to the girder beams 22 using conventional joining techniques such as molding, riveting and bolting. The overlapping ends 28 can be butt-jointed as shown at the connection 30 or can be offset (not shown) from each other. It is important primarily that the joists 26 be aligned relative to each other and spaced at an appropriate, required distance.

After all the joists in a given bay or bays 24 are secured, decking 42 is laid over the joist system. As detailed in FIG. 2, decking typically consists of a corrugated panel formed as a continuous section from light-gauge steel or another suitable material. The decking 32 is laid in a continuous pattern of the floor joists 26 and secured at various points by through-welding, riveting, bolting or other mechanical interconnection methods to the joists. The decking pieces are interconnected at joints 34 by overlapping (nesting) two pieces. The corrugations allow two pieces of decking to be nested in whole, or in part, with each other. Hence, a relatively continuous decking surface can be formed. Openings 38 can be placed at various points in the decking to allow HVAC, stairways, elevators and other access-ways to pass through floors. Decking sections are typically left open with spaces 40 around girder beams 22. Open spaces 40 enable construction operations to proceed more easily. These open spaces 40 are covered with overlapping pieces of decking 32 prior to completion. A given floor formed from decking 32 is usually covered with concrete or a similar matrix at some point in the construction process. Floors can be added above each finished level using the same technique, but at increasingly higher altitudes.

A disadvantage of construction according to the above-described technique is that erectors and riggers must spend substantial time working high in the air on the uncompleted framework. The more time spent in the air, the greater the risk of a fall or other personal injury. It is more difficult for all workers to complete their tasks in a suspended structure. These tasks become particularly dangerous and difficult in high-rise structures where the framework extends upwardly a great many floors, all of which must be constructed by the above-described technique.

Occupational Safety and Health Administration (OSHA) rules dictate that all workers must be tethered or tied to the structure, for fall-arrest purposes for any open structure over 6 feet in height. The one exception to this rule are the erectors themselves, who need to be tethered when working over 25 feet up. This rule may be changed to require that even erectors be tethered when working more than 6 feet up.

The result of fall-arrest requirements is that substantial time and money are spent in protecting workers who must spend a great deal of time suspended aloft in uncompleted structures. Fall-arrest techniques slow the construction process and substantially increase costs.

It is, therefore, an object of this invention to provide a system and method for constructing metal frame structures that reduce the need for fall-arrest and that enables construction of larger portions of a structure at ground level. This system and method should be easy to implement at a construction site, should allow a reasonable level of variation in framework size and should enable the construction of building components having a reasonably high level of accuracy and repeatability.

SUMMARY OF THE INVENTION

This invention avoids the disadvantages of the prior art by providing a system that enables a large portion of the assembly of decking and floor joists to occur while still on the ground, thus alleviating the need for substantial fall-arrest during assembly. This invention enables accurate alignment of corrugated decking relative to the floor joists to alleviate the problems of misalignment that may occur if decking is simply attached to floor joists without any kind of prior gauging.

A system and method for constructing metal frame structures provides a framework in the form of a jig that is typically assembled at a construction site at ground level. The jig is filled with joists that are typically parallel to each other and spaced at predetermined intervals along the jig. A pair of indicator jig sections are used at either end of the grouping of floor joists. These indicators include a corrugated decking surface along their top. Decking sheets are laid over the floor joists so that they nest within the indicator decking. The decking is permanently joined to the floor joists, but not the indicator decking. The assembled decking and floor joists are lifted by a lifting jig from the framework and positioned within a building framework. Further sections are constructed using the same technique until a floor or roof surface is formed over the entire framework. Utilities can be located within the assembled decking and floor joist framework while it is still on the ground.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 2:
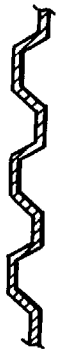
Fig. 2 (PRIOR ART)
FIG. 2 is a partial cross section of a decking material according to the prior art.
Figure 1:
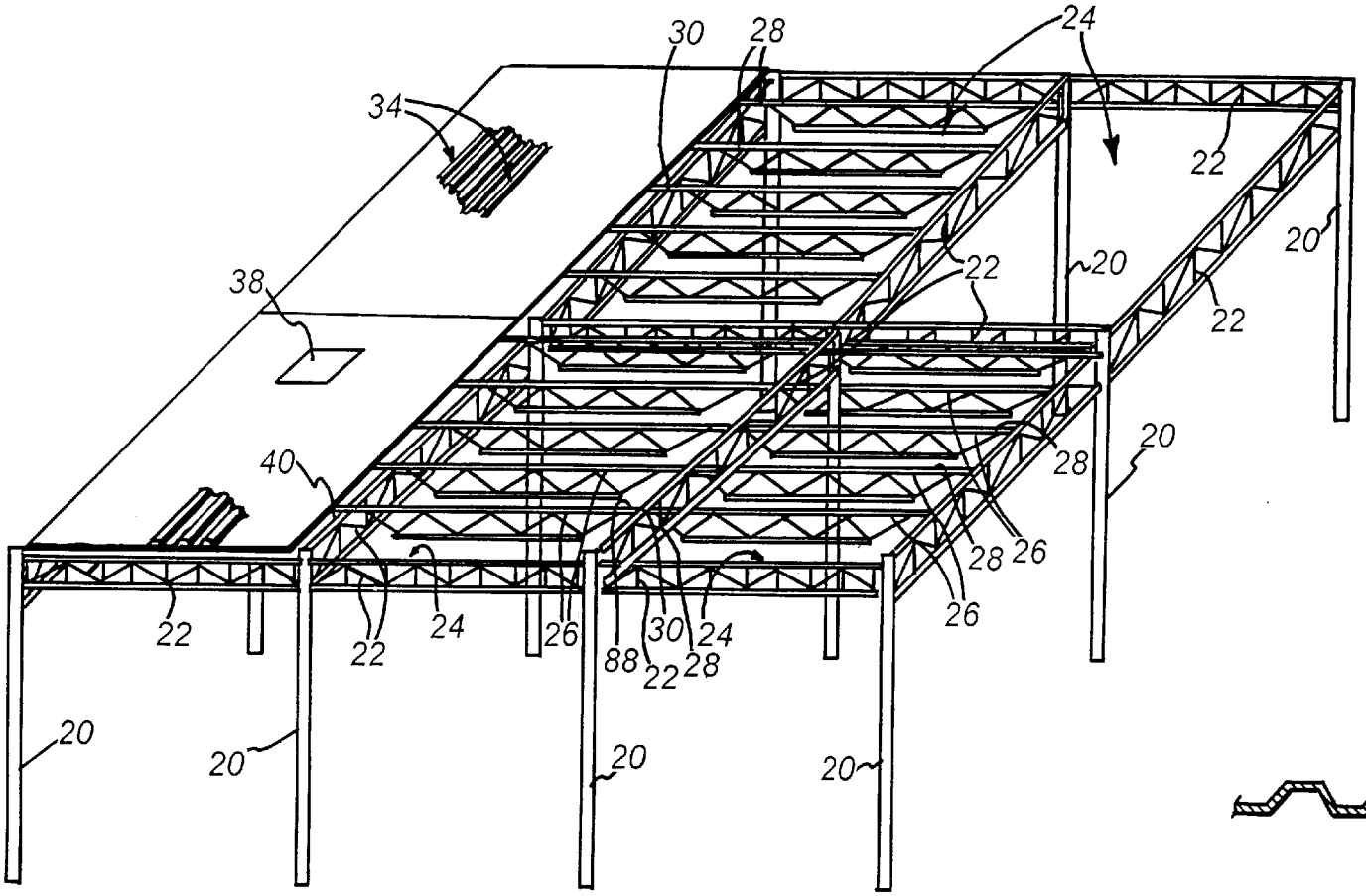
Fig. 1 (PRIOR ART)
FIG. 1 is a schematic perspective view of a structure-in-progress constructed according to a prior art method.
Figure 3:
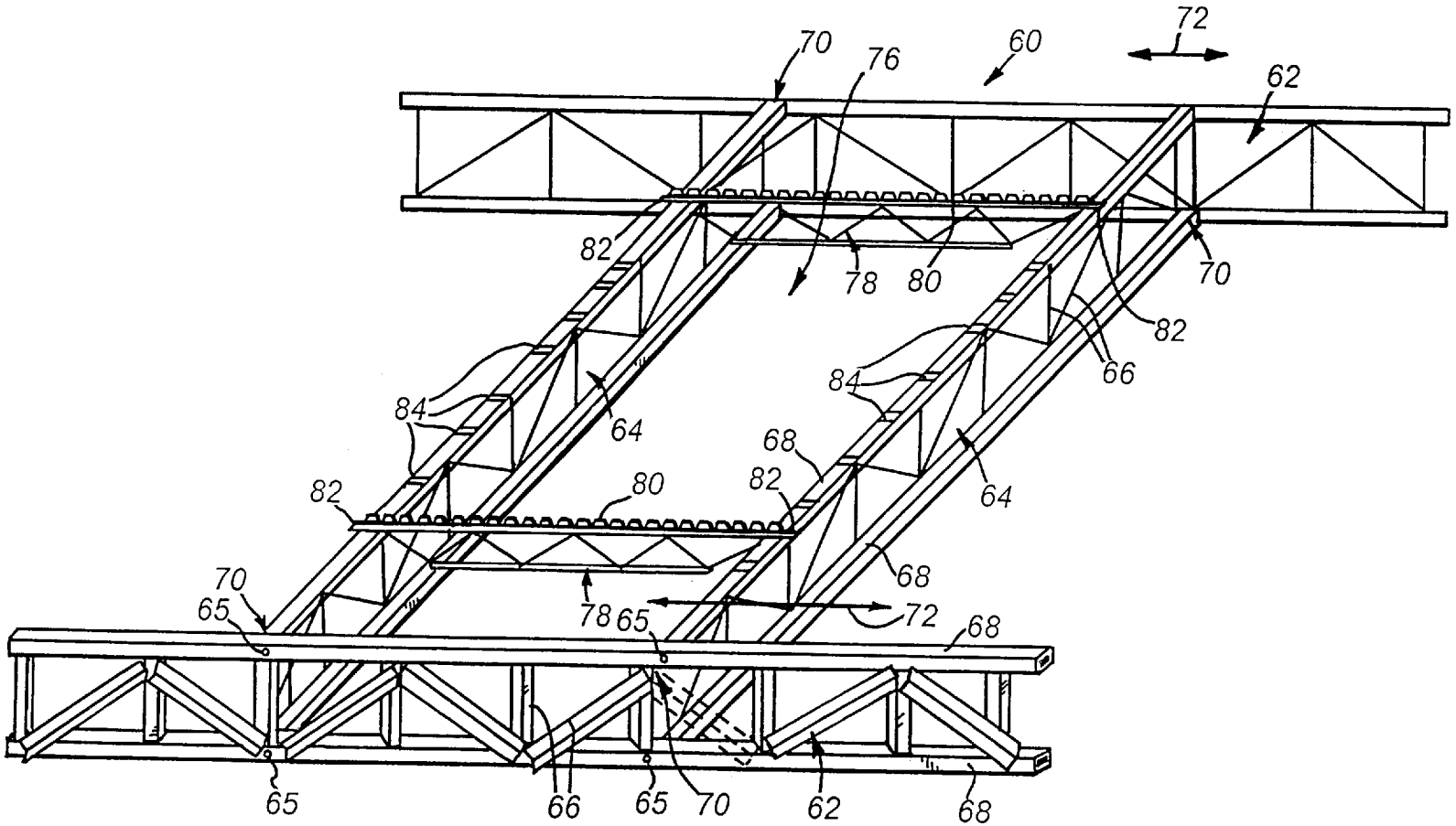
FIG. 3 is schematic perspective view of a frame construction jig according to this invention.

It is recognized that modular construction techniques have revolutionized the construction of low-cost housing and dwellings. Prefabricated panels are used to construct accurately-sized homes in a minimum amount of time. The panels have a good fit and assemble together quickly. Similar techniques can be applied to the construction of large metal frame buildings. FIG. 3 illustrates a truss grid work 60 constructed from outer frame members 62 ("jigging trusses") and inner frame members 64 ("main jigging trusses"). The inner and outer frame members include a truss-like cross-beams 66 that can comprise L-beams or channel-beams that are welded or bolted together to form a strong unit. The frame member 62 and 64 can, essentially, comprise building-type girder beams like the girder beams 22 in FIG. 1. They can be sized and shaped similarly to those used in structures. For added strength, the top and/or bottom of each frame member can include a stiffening member 68, such as a square cross section tubular brace (approximately 6 inch by 6 inch in dimension) that maintains each of the frame members in a straight-line alignment. The inner frame members 64 are tied to the outer frame members 62 at connections 70 that can be formed using bolts, clamps, brackets or any other suitable connecting technique. It is contemplated that the inner and outer frame members 64 and 62, respectively, can be assembled and disassembled on site as needed. They can be quickly loaded and unloaded from a flatbed truck and laid on any acceptable relatively flat surface at a construction site. The general attachment arrangement for individual frame members to each other throughout the truss system described herein as shown in foreground outer frame member 62 in FIG. 3 and the gridwork 60 is held together by exemplary bolts 65.

Figure 4:
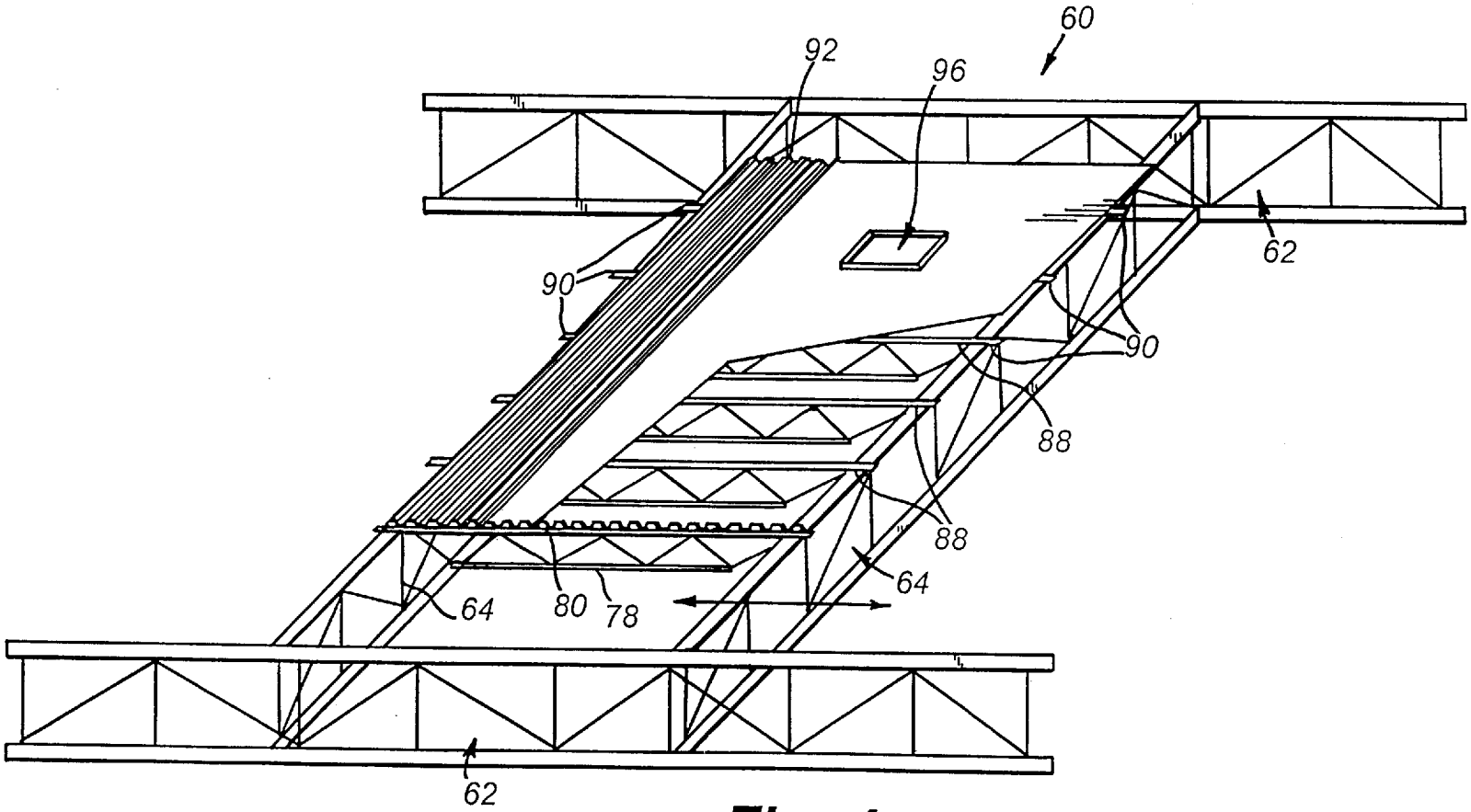
FIG. 4 is a schematic perspective view of the construction of a floor/roof module using the jig of FIG. 3.

The inner frame member 64 can be moved to various positions along the length (see arrows 72) along the outer frame members 62. Likewise, additional sections can be attached to either the inner or outer frame members to form longer sections. These additional sections (not shown) can be attached using bolts, clamps or similar attachment mechanisms. When a desired size is obtained, the area defined between the inner and outer frame members 64 and 62, respectively forms a template bay 76 that defines the size of a given module according to this invention. Within this bay are placed a pair of indicator or "template" floor joists 78 that have, welded thereonto, strips of the corrugated decking 80 or decking-like material. The decking strips are somewhat flexible and, thus, they are joined at regular intervals to the top of each floor indicator joist 78. In this embodiment, the indicator floor joists are laid atop the inner frame members 64 so that their ends 82 overhang the upper edge of the inner frame member 64. A series of indication marks or channels 84 are placed at regular intervals along the top of each inner frame member 64. The marks can comprise grooves, paint marks 84, weld spots or any other suitable structure positioned at relatively constant intervals. Into each of the marks, as further detailed in FIG. 4, are positioned standard floor joists 88.

These floor joists, unlike the indicator floor joists 78, do not include preformed corrugated sections along their tops. All joists 78 and 88, however, remain non-permanently fastened to the inner frame members 64. According to this invention, an appropriate series of floor joists 88 are laid into the jig framework 62, 64 at the marks 84, forming a parallel, accurately aligned grouping of joists. Each of the joists overhang the inner frame member at an end section 90.

When all floor joists 88 have been located within the jig framework 62, 64, decking 92 is applied over the structure. The decking 92 lays onto the decking strip 80 of the indicator floor joists 78. Hence, the decking 92 remains accurately aligned relative to the framework jig 60 at all times. Once all decking 92 is applied and, where appropriate, openings 96 are formed, the decking 92 is permanently secured to the floor joists 88. The decking 92 is not typically secured permanently to the indicator floor joists 78. Note that the decking is fairly flexible and, thus, it bends to accommodate slight variations in alignment and height. Such a variation in height exists on each indicator floor joist 78 due to the provision of a decking strip 80. This decking strip can also include a lower backing strip formed from thin gauge steel or another metal to further reinforce the strip 80 and prevent it from deforming.

The decking 92 can be secured to the floor joists 88 by any acceptable method including through-welding, riveting, bolting and other mechanical joining techniques. Enough connections joints should be applied to the decking to ensure that it is relatively secure and can survive lifting and movement onto the building (as will be described further below).

Figure 5:
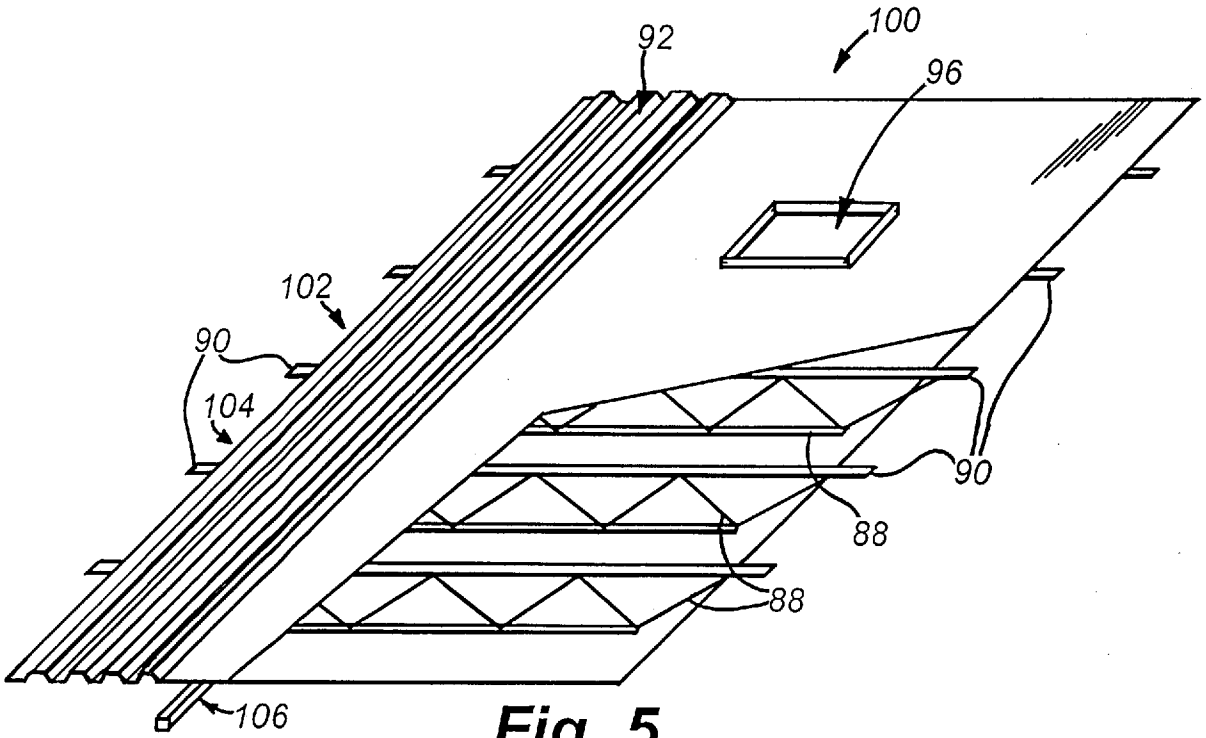
FIG. 5 is a schematic exposed perspective view of a completed floor/roof module according to this invention.

FIG. 5 illustrates a completed floor module 100 as constructed according to the process shown in FIG. 4. The module 100 is shown without the surrounding jig framework. While the module is in the construction stage, it can be assumed that the jig framework 62, 64 will remain in place. Typically, the module 100, as described below, is lifted as a unit from the jig. The decking aligning indicator floor joists 78 (FIG. 4) will remain within the jig 62, 64 while the assembled elements of the module 100 are will be lifted as a group. As described above, a space exists between the edge 102 of the decking and the overhanging joist ends 90. These joist ends are meant to rest upon girder beams 22 of the framework of a building while forming an open space 104 (see also FIG. 7) between the edge 102 of the decking and the girder beams 22.

One advantage of the construction technique according to this invention is that openings 96 and other utilities such as piping, HVAC ducts and conduits 106 can be mostly attached to a module while it is still on the ground. This makes the process much easier, and safer, for tradesmen and specialists to install their various subsystems and construction details without the need to be suspended high above the ground. It may still be necessary to make connections between modules, but this process proceeds much quicker and with substantially less difficulty than installing complete subsystems from start to finish in the air.

While the "modules" according to this invention are said to be floor modules, it is contemplated that they can also comprise roof modules according to this invention. In other words, a one-story building may only include a single set of modules on its top surface. These modules generally will comprise a roof, rather than a floor for an additional story. However, the techniques described herein are the same whether modules comprise roof sections or floor sections.

Figure 6:
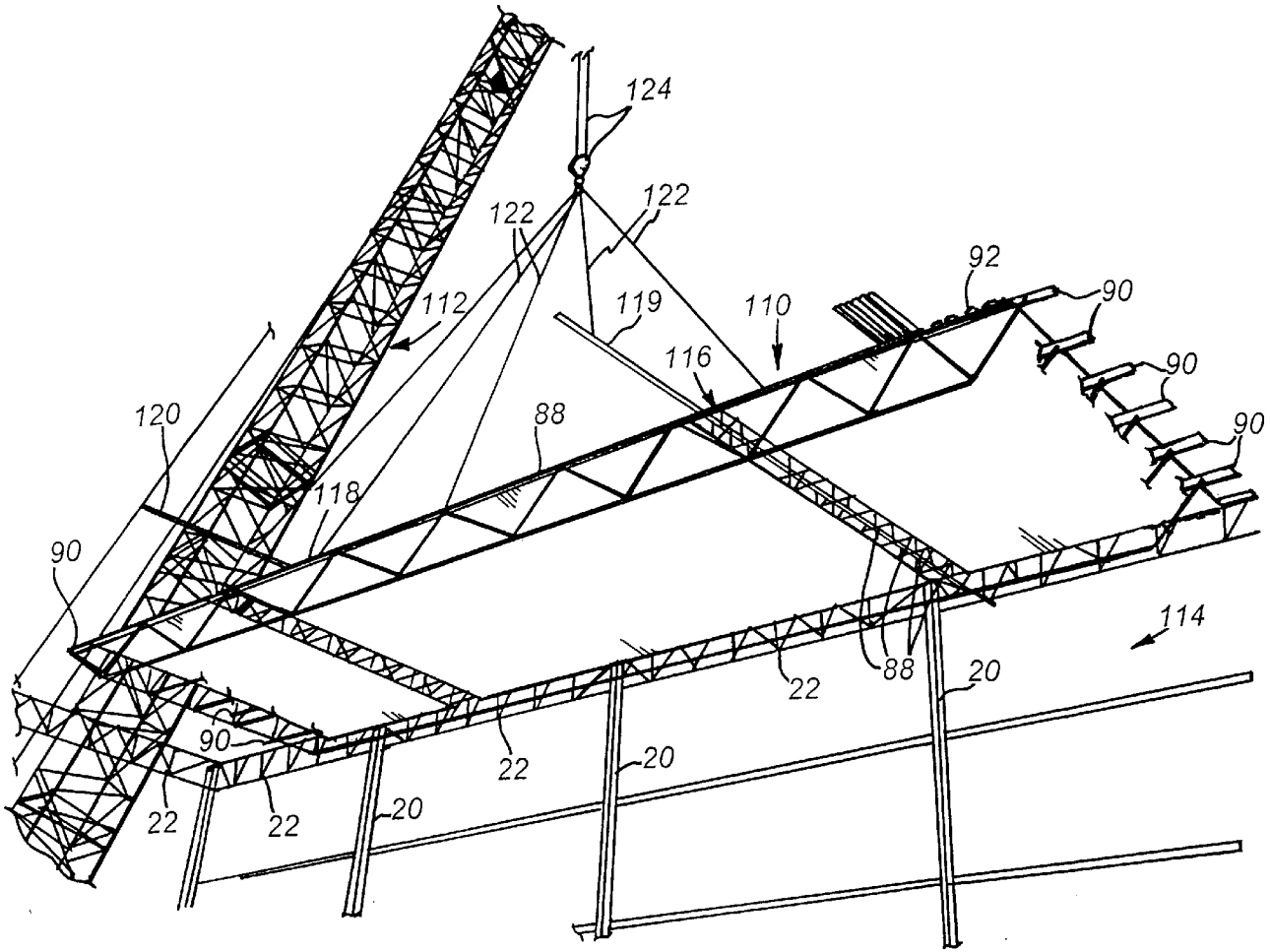
FIG. 6 is a schematic view of the placement of a floor/roof module according to this invention using a lifting jig.

As detailed in FIG. 6, a large elongated module 110 is shown lowered by a crane 112 onto a building framework 114. Note that the module 110 in this embodiment spans several columns 20. Hence, a single module 110 need not be sized within a single square or rectangle of columns 20. Rather, the module can span several columns forming a given bay.

In this embodiment, the decking 92 has been opened along two linear spaces 116 and 118. A pair of lifting jigs 119 and 120, respectively, are been attached to each of the joints 88 within the respective open spaces 116 and 118. The lifting jigs 119 and 120 are a pair of heavy square beams sized and shaped to support a module. A series of lines 122 connect the lifting jigs 119 and 120 to the pulley system 124 of the crane 112. The crane is used to lift the module 110 out of its jig, once all module assembly steps have been completed and to carefully lower it into position within the framework 114. The joist ends 90 are positioned to overhang the girder beams 22. Once a final positioning has been accomplished, the joist ends 90 are secured to the girder beams 22 using any acceptable permanent securing technique.

Figure 7:
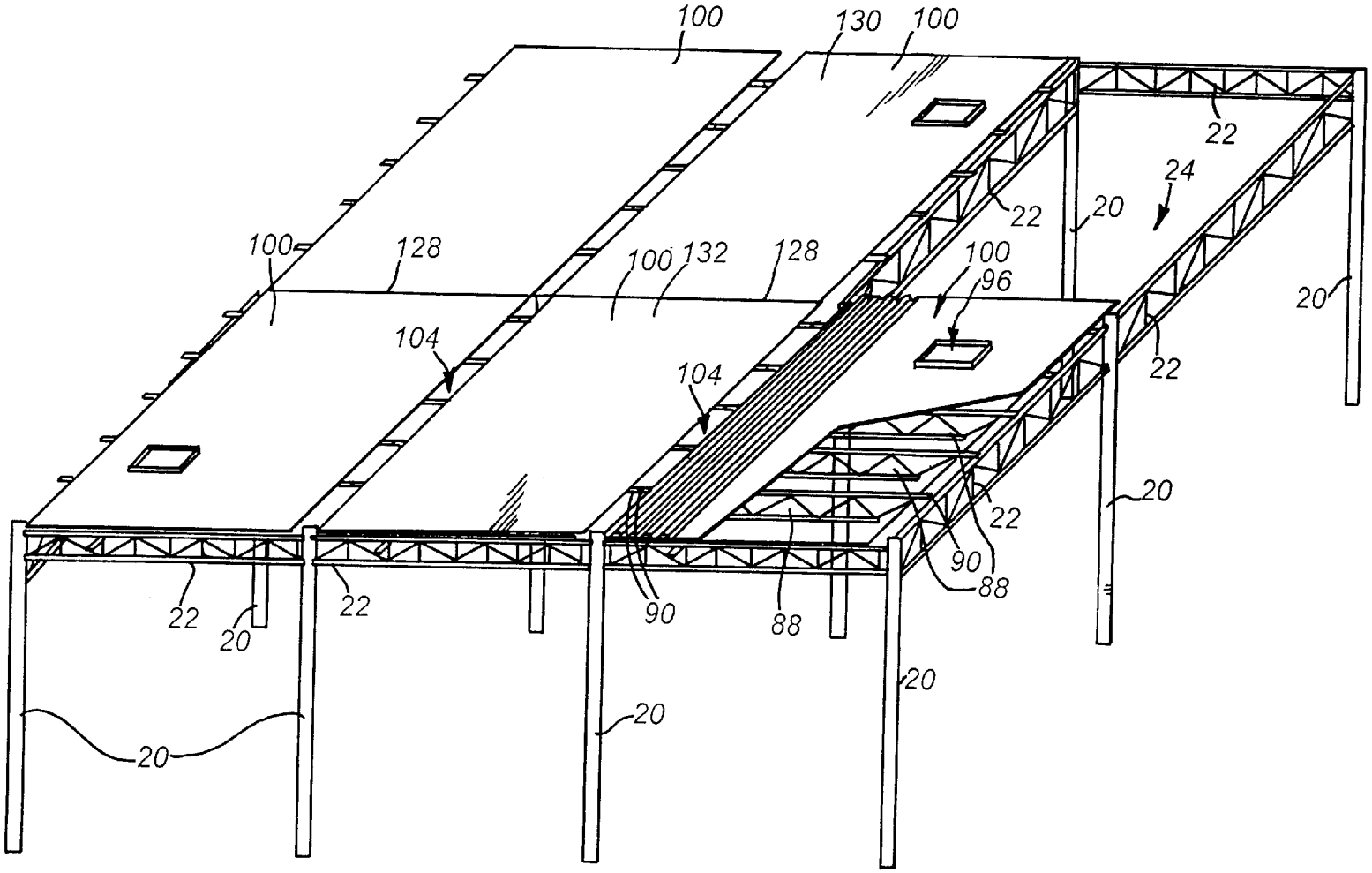
FIG. 7 is a schematic exposed perspective view of a partially-completed structure using floor modules according to this invention.

As shown in FIG. 7, the modules 100 of this invention are positioned adjacent each other in respective bays 24. Each of the modules formed according to this technique is well aligned and the decking on any given module is substantially identically-positioned relative to the decking on an adjacent module. Thus, the decking sections overlap (nest) easily at joints 128. Using the technique described herein, a tolerance of one-eighth inch or better for decking alignment can be obtained. This allows one set of decking to nest easily within an adjacent set. Any slight misalignment can be accounted for by stretching the decking slightly. Decking is relatively thin-gauge metal and, thus, it has a built-in tolerance to some misalignment.

The space 104 between modules 100 as shown in FIG. 7 should be relatively accurately gauged. Eventually, the spaces 104 are filled with nested pieces of decking that overlap the adjacent side edges of each module. During installation, pieces of decking can be used as a gauge to ensure that adjacent modules are laid upon the girder beams 22 a proper space from each other. Using such a technique, a module would be brought down slowly onto the framework and moved around gradually until an interstitial piece of decking easily overlays and nests within two adjacent pieces of decking between a given space 104. Alternatively, the space between decking sections can be measured as a new module is dropped into position to ensure proper alignment. Maintaining proper alignment is less difficult in overlapping pieces such as the overlapping module sections 130 and 132 shown in FIG. 7. The first module to be positioned 132 will form a guide for the nesting of the second module 130. Note that, in this particular embodiment, decking is laid so that the corrugations run transversely to the joists. While it is possible to run corrugations in parallel to the joists, it is typically less desirable since it makes joist alignment more-dependent upon the location of corrugation "troughs".

Figure 8:
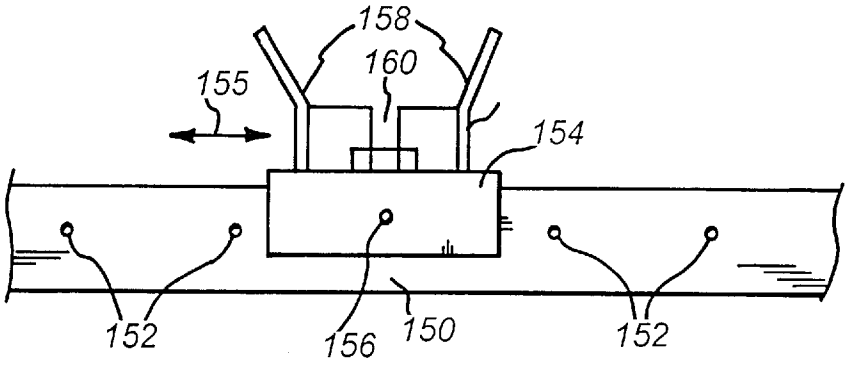
FIG. 8 is a schematic side view of a joist alignment structure according to an alternate embodiment of this invention.

As described above, the jig structure according to this invention can be provided with a variety of improvements that enable extension of the structure and movement of jig frame members to different sizes and positions. FIG. 8 shows an alignment structure for use along the top portion 150 of a jig frame member (main jigging truss). The top portion 150 has been provided with a series of attachment locations in the form of holes 152 at regular intervals corresponding to desired roof joist positioning. A bracket 154 rides upon the top 150 (arrow 155) and includes a corresponding pin 156 for engaging the holes 152. In this embodiment, the bracket 154 supports a pair of guide wings 158 and a slot 160 that enable very accurate positioning of a joist thereinto. A series of such brackets can be provided along a frame member for highly accurate alignment of joists.

The foregoing has been a detailed description of preferred embodiments of the invention. Various modifications and additions can be made without departing from the spirit and scope of this description. For example, while rectangular and square jigs and modules are shown, the techniques herein can be used to form polygonal or rounded modules. It is required primarily that the frame members forming the jig be constructed so that, when assembled, they take the shape of the appropriate module. Custom-sized jigs can be formed for specific jobs or, standardized sizes can be employed where appropriate. Accordingly, this description is meant to be taken only by way of example, not to otherwise limit the scope of the invention.

What is claimed is:

1. A method for constructing a metal frame structure comprising the steps of:

erecting a structure frame having columns and a gridwork of girder beams supported by the columns, each of the girder beams being remote from a ground surface and the girder beams defining at least one bay having a predetermined size and shape within the girder beams;

assembling a jig having a plurality of frame members adjacent the ground surface and remote from the structure frame, the frame members approximately defining the predetermined sized and shape of the bay;

detachably locating a plurality of joists so that each of the joists is supported by a pair of the frame members;

locating at least one decking template joist between the pair of the frame members, the decking template joist including a raised projection surface for receiving corrugated decking thereon in a predetermined registration;

locating decking over the plurality of joists in engagement with the plurality of joists and in engagement the raised projection surface in the predetermined registration therewith;

permanently attaching the decking in the predetermined registration to each of the plurality of joists, so that the decking and the joists together define a module;

removing the module from the frame members, including lifting the module away from the frame members and into position remote from the ground surface adjacent the bay defined by the girder beams; and lowering the module into position within the bay so that the joists are supported by the girder beams.

2. The method as set forth in claim 1 wherein the step of detachably locating the plurality of joists further comprises positioning the joists at locations along the frame members so that the joists are substantially parallel to each other and are located at predetermined marked location points along the frame members.

3. The method as set forth in claim 1 wherein the step of locating at least one decking template joist includes positioning the decking template joist adjacent and end of a grouping of the plurality of joists.

4. The method as set forth in claim 3 further comprising positioning another decking template joist having a raised projection surface for receiving corrugated decking thereon in the predetermined registration adjacent an opposite end of the grouping of the plurality of joists.

5. The method as set forth in claim 1 wherein the step of locating at least one decking template joist includes providing, on a top of the frame member, a strip of decking-like material positioned thereon and wherein the step of applying decking over the decking template joist includes nesting the decking over the strip of-like material.

6. The method as set forth in claim 1 further comprising attaching utility systems to the module when the module is located relative to the frame members, prior to the step of lifting.

7. The method as set forth in claim 1 wherein the step of detachably locating the plurality of joists includes positioning the joists in movable alignment structures mounted on each of the pair of frame members.

8. The method as set forth in claim 1 further comprising locating a detachable lifting jig on the module prior to the step of lifting.

9. The method as set forth in claim 1 further comprising, moving the frame members relative to each other to define a different size and shape than the size and shape defined by the bay.

* * * * *